US009662524B1

(12) United States Patent
Celone et al.

(10) Patent No.: US 9,662,524 B1
(45) Date of Patent: May 30, 2017

(54) GOLF TRAINING APPARATUS

(71) Applicant: CPY 2 LLC, Naples, FL (US)

(72) Inventors: Thomas J. Celone, Reno, NV (US); James Yablonowski, Cedar Lake, IN (US); Randall Yablonowski, Plainfield, IN (US); Cindy Yablonowski, Naples, FL (US)

(73) Assignee: CPY 2 LLC, Naples, FL (US)

( * ) Notice: Subject to any disclaimer, the term of this patent is extended or adjusted under 35 U.S.C. 154(b) by 0 days.

(21) Appl. No.: 15/250,213

(22) Filed: Aug. 29, 2016

Related U.S. Application Data

(60) Provisional application No. 62/350,959, filed on Jun. 16, 2016.

(51) Int. Cl.
*A63B 69/36* (2006.01)
*A63B 21/00* (2006.01)
*A63B 21/008* (2006.01)

(52) U.S. Cl.
CPC .... *A63B 21/00061* (2013.01); *A63B 21/0088* (2013.01); *A63B 69/3632* (2013.01)

(58) Field of Classification Search
USPC ..... 473/219, 223, 226, 228, 229, 256, 422, 473/451, 457; 482/111, 112, 148
See application file for complete search history.

(56) References Cited

U.S. PATENT DOCUMENTS 1,306,915 A 6/1919 Klamroth
4,576,378 A 3/1986 Backus
5,100,148 A 3/1992 Smith
5,165,683 A 11/1992 Beutler et al.
5,184,825 A 2/1993 Ruth
5,207,625 A * 5/1993 White ..... A63B 21/00069 473/228
5,310,188 A 5/1994 Hernberg
5,335,918 A 8/1994 Rupnik et al.
5,415,406 A 5/1995 Reichenbach et al.
5,571,048 A 11/1996 Kenney
6,238,299 B1 5/2001 Barnette
6,881,156 B1 4/2005 Phillips
7,004,850 B1 2/2006 Hong
7,285,055 B2 10/2007 Radle
7,384,344 B2 6/2008 Aguirre
(Continued)

FOREIGN PATENT DOCUMENTS

WO 2014075150 5/2014

*Primary Examiner* — Nini Legesse
(74) *Attorney, Agent, or Firm* — Nilay J. Choksi; Smith & Hopen, P.A.

(57) ABSTRACT

A sports training device designed for attachment to the shaft of a swinging sports apparatus, such as a golf club, tennis racket, baseball bat, hockey stick, or any other sports apparatus that is intended to be swung while playing a sport. The training device generally includes a drag panel/chute/airfoil, two (2) distinct connection points to the sports apparatus, and a support rod is disposed between the connection points substantially parallel to the shaft of the sports apparatus and to the length of the drag panel. The connection points include coupling mechanisms (e.g., pipe clips, snap clamps, etc.) that allow for 360° rotation about the sports apparatus. In use, the drag panel provides additional air resistance during the swinging of the sports apparatus.

16 Claims, 16 Drawing Sheets

(56) References Cited

U.S. PATENT DOCUMENTS

| | | | | |
|---|---|---|---|---|
| 7,497,785 | B2 | 3/2009 | Koncelik, Jr. | |
| 7,762,929 | B1 * | 7/2010 | Celone | A63B 21/0088 482/109 |
| 8,202,204 | B2 | 6/2012 | Celone et al. | |
| 8,506,414 | B2 * | 8/2013 | Snyder | A63B 53/00 473/226 |
| 8,905,871 | B2 * | 12/2014 | Wagner | A63B 69/0002 473/422 |
| 8,998,740 | B2 * | 4/2015 | Corcoran | A63B 21/0088 473/228 |
| 2011/0009208 | A1 * | 1/2011 | Roger | A63B 53/04 473/317 |

* cited by examiner

GOLF TRAINING APPARATUS

CROSS-REFERENCE TO RELATED APPLICATIONS

This nonprovisional application claims priority to U.S. Provisional Patent Application No. 62/350,959, entitled "Sports Training Device", filed on Jun. 16, 2016, the entirety of which is incorporated herein by reference.

BACKGROUND OF THE INVENTION

1. Field of the Invention

This invention relates, generally, to sports exercise equipment. More specifically, it relates to a device that exercises muscles and improves performance in sports that require swinging an apparatus, such as a club, bat, stick, or racket, having an elongate shaft 2. Brief Description of the Prior Art Sports swing training apparatuses that provide additional air/wind resistance are known in the art, though each has its own respective drawback. There are devices that include an airfoil on the golf club/sporting equipment but are fixed (i.e., non-rotational), devices that include an airfoil on the golf club/sporting equipment and can rotate about the club shaft but not the entire way around (360°) around the shaft, and devices that include an airfoil on the golf club/sporting equipment and permit 360° rotation about the club shaft but are overly complex. Referring to devices that have a fixed airfoil, examples include Rupnik (U.S. Pat. No. 5,335,918), Backus (U.S. Pat. No. 4,576,378), Kenney (U.S. Pat. No. 5,571,048), Smith (U.S. Pat. No. 5,100,148), Ruth (U.S. Pat. No. 5,184,825), Hernberg (U.S. Pat. No. 5,310,188), Reichenbach (U.S. Pat. No. 5,415,406), Barnette (U.S. Pat. No. 6,238,299), Hong (U.S. Pat. No. 7,004,850), and Namba (U.S. Pat. No. 7,118,490). Certain airfoils have been taught to be rigid, and other airfoils have been taught to be flexible; in either case, the airfoil can attach to the golf club, where the airfoil trails the golf club during a swing. Many of these references discuss a natural rotation of the golfer's wrist during a swing, but the airfoil remains in its fixed position along the club shaft during the entire swing.

Now referring to airfoils coupled to golf clubs and capable of having some rotation. Examples include Beutler (U.S. Pat. No. 5,165,683), Radle (U.S. Pat. No. 7,285,055), Celone (U.S. Pat. Nos. 7,762,929 and 8,202,204), and Roger (WO 2014/075150). Each of these references appear to allow only partial rotation of the airfoil about the club shaft (rather than 360° rotation). Examples of references that discuss 360° rotation include Aguirre (U.S. Pat. No. 7,384,344) and Koncelik, Jr. (U.S. Pat. No. 7,497,785). However, whereas Aguirre is overly complicated, Koncelik would appear to result in errors and entanglement, along with lower air resistance during a swing due to the airfoil being parallel the user's swing path.

Accordingly, what is needed is a device that allows a full, 360° range of motion around the shaft of the club, bat, stick, or racket to provide the sufficient air resistance for training no matter how a person swings the club, bat, stick, or racket. Additionally, the prior art fails to teach a support rod which runs parallel to the shaft of a club, bat, stick or racket and connects each end point of the device to provide rigidity. Also, the support rod prevents entanglement of the device around the shaft. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a sports exercise device that attaches to the elongate shaft of a swinging sports equipment (e.g., club, bat, stick, or racket) by way of pipe clips or a functional equivalent, rotates 360°, and is supported by a support rod is now met by a new, useful, and nonobvious invention.

In an embodiment, the current invention is a swinging sports exercise/training apparatus for attaching to a shaft of a sports apparatus. The training apparatus includes a proximal coupling mechanism and a distal coupling mechanism, both of which may be generally annular in shape. The proximal coupling mechanism is disposed around the proximal portion of the sports apparatus shaft, where it has an inner diameter that is larger than an outer diameter of the sports apparatus shaft, such that the entirety of the proximal coupling mechanism can substantially freely rotate about the sports apparatus shaft. Similarly, the distal coupling mechanism is disposed around the distal portion of the sports apparatus shaft, where it has an inner diameter that is larger than an outer diameter of the sports apparatus shaft, such that the entirety of the distal coupling mechanism can substantially freely rotate about the sports apparatus shaft.

The training apparatus further includes a rigid support rod (e.g., Young's modulus of at least 10 GPa) disposed in substantially parallel relation to the sports apparatus shaft, where its proximal end is secured to/in the proximal coupling mechanism (e.g., via insertion into a slot in the proximal coupling mechanism and further optionally a bolt/screw/stud used to tighten the support rod in the proximal coupling mechanism) and its distal end is secured to/in the distal coupling mechanism (e.g., via insertion into a slot in the distal coupling mechanism and further optionally a bolt/screw/stud used to tighten the support rod in the distal coupling mechanism), such that rotation of the coupling mechanisms about the sports apparatus shaft is synchronized with rotation of the support rod. Optionally, the support rod may include slip connectors therein for disassembling and folding the support rod. Further, an elastic cord can run through the interior of the support rod along its length to keep the disassembled support rod segments together.

The training apparatus further includes a drag panel (e.g., trapezoidal shape) disposed substantially parallel to the rigid support rod, where its proximal end is directly or indirectly coupled to the proximal coupling mechanism and its distal end is directly or indirectly coupled to the distal coupling mechanism. The panel can also then rotate in synchronization with the coupling mechanisms around the sports apparatus shaft. When in use, the panel may be substantially taut during swinging of the sports apparatus, due to air stretching out the flexible panel.

With this configuration, the training device can rotate about the shaft of the sports apparatus in a direction normal to a velocity vector of a swing so that the user of the sports apparatus experiences an increased resistance during the swing. Further, the proximal coupling mechanism, the distal coupling mechanism, the support rod, and the panel collectively rotate in synchronization with each other. In other words, none of those components remain affixed to the sports apparatus shaft, due to their synchronized rotations.

The training apparatus may further include a pair of stiffener elements, one disposed at each end of the drag panel. This permits the proximal and distal edges of the panel to remain perpendicular to the sports apparatus shaft. In a further embodiment, cable seals can be used to couple the stiffener elements to the coupling mechanisms, thus indirectly coupling the ends of the panel to the coupling mechanisms.

If it is desired that the training apparatus should not move or translate along the length of the sports apparatus shaft, a clamp can be positioned on the shaft in a position proximal to the proximal coupling mechanism. This would stop the proximal coupling mechanism from moving further proximal than the position of the clamp.

Now referring to the coupling mechanisms specifically, each coupling mechanism may include a passageway therethrough, through which the sports apparatus shaft would be disposed. Each coupling mechanism can also have an entry/exit opening through which the sports apparatus shaft can enter and exit that passageway. In this situation, the length of the opening should be smaller than the outer diameter of the sports apparatus shaft, thus preventing the sports apparatus shaft from freely exiting the passageway in an undesired manner.

In a separate embodiment, the current invention is a golf training apparatus for attaching to a shaft of a golf club, where the golf training apparatus can include any one or more, or even all, of the features and characteristics described herein.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1A:
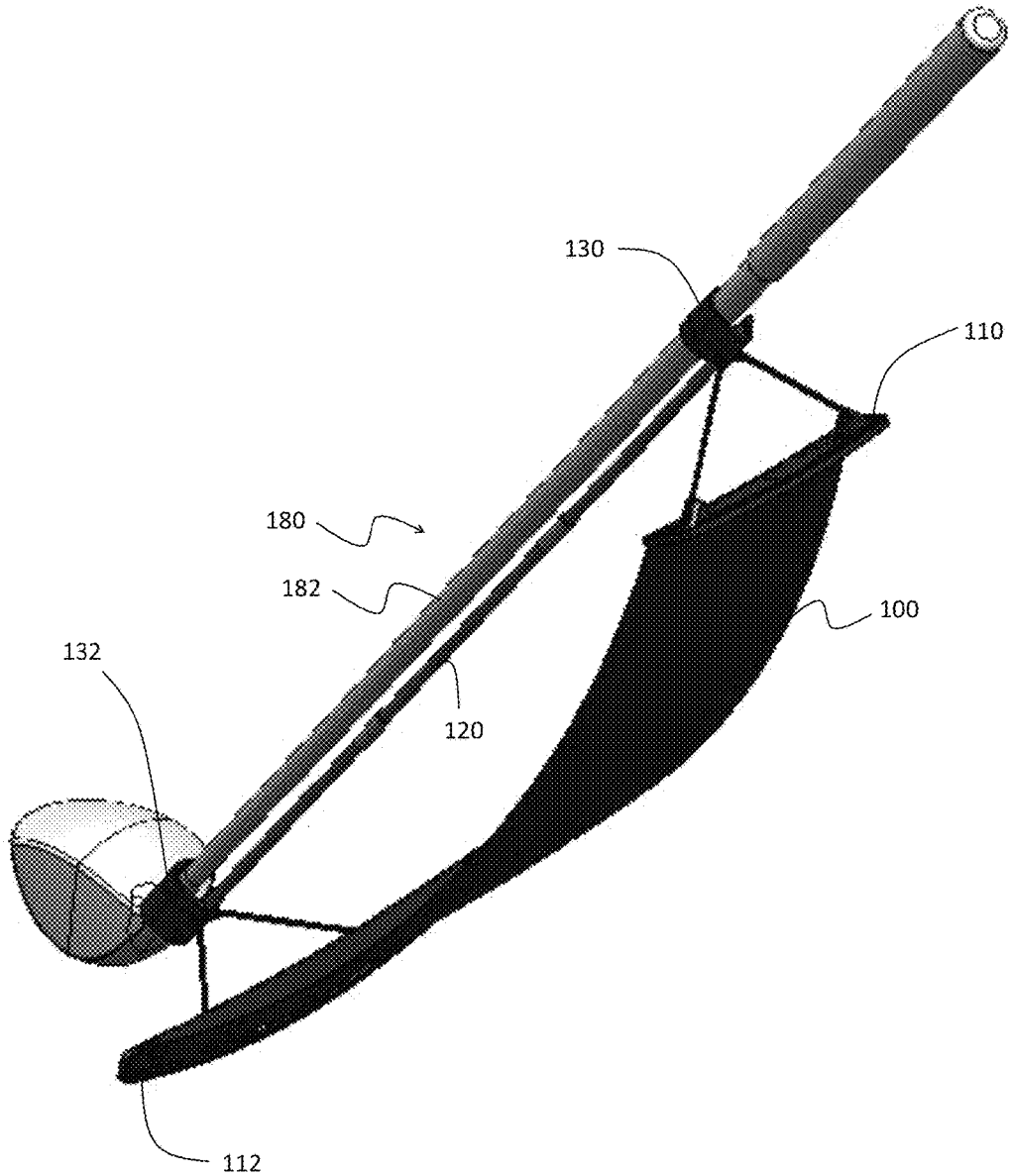
FIG. 1A is a rear perspective of a golf training device, according to an embodiment of the current invention.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

In certain embodiments, the current invention is a swing training device coupled to a swinging sports apparatus, such as a golf club. The invention will be described and illustrated herein as applied to a golf club, but it can be understood how the device can be applied to other swinging sports apparatuses as well. The device has two (2) distinct connection points (proximal and distal connection points) between the device and the sports apparatus shaft, where the proximal connection point is disposed at the proximal end of the device and the distal connection point is disposed at the distal end of the device. The term "proximal" is used herein to refer to a relative position of a structural component being closer to a user of the underlying swinging sports apparatus, whereas the term "distal" is used herein to refer to a relative position of a structural component being further from the user of the underlying swinging sports apparatus.

The training device further includes an elongate, rigid support rod and an elongate drag panel/chute (formed of a flexible resistance material) disposed between the two (2)

coupling points. Coupling between the training device and the golf club is achieved by a pipe clip, snap clamp, or similar mechanism disposed on each end of the support rod, which, due to being secured to the coupling mechanisms, maintains a spaced distance between the coupling points along the sports apparatus and maintains deployment of the panel/chute. One end of the panel/chute is coupled to either an end of the support rod or one of the pipe clips/snap clamps, and the other end of the panel/chute is coupled to the other end of the rod or the other pipe clip/snap clamp. As such, the lengths of the rod and panel/chute are disposed in substantially parallel relation to each other when deployed on the sports apparatus. The pipe clips/snap clamps each have an inner diameter that is slightly larger than an outer diameter of the sports apparatus shaft, sufficient to allow the pipe clips/snap clamps to rotate 360° around the sports apparatus shaft.

Referring specifically to the drag chute/panel, the panel has a proximal edge and a distal edge. The proximal edge of the panel is kept taut perpendicular to the swing path of the sports apparatus by a proximal stiffener element. Similarly, the distal edge of the panel is kept taut perpendicular to the swing path of the sports apparatus by a distal stiffener element. The panel is kept relatively taut substantially parallel to the length of the shaft of the sports apparatus by the elongate support rod. The support rod has a proximal end and a distal end. The support rod is attached to pipe clips or an equivalent thereof at each of its ends by two screws or other suitable mechanism. These screws secure the pipe clips to the support rod. The proximal stiffener element and the distal stiffener element each can have two cable seals that are coupled to the support rod and are secured in place in between the screws on each pipe clip. The pipe clip at the proximal end of the support rod is stopped from sliding up the sports apparatus shaft by a rubber clamp that is attached immediately proximal to the pipe clip at the proximal end of the support rod. The pipe clip at the distal end of the support rod can also be stopped from sliding down the sports apparatus shaft by a rubber clamp that is attached immediately distal to the pipe clip at the distal end of the support rod. If the current training device is used on a golf club, as is illustrated herein, the head of the golf club prohibits the pipe clip at the distal end of the support rod from sliding down the club shaft.

With this configuration, all components of the training device are capable of rotating simultaneously around the shaft of the sports apparatus (e.g., golf club), thus eliminating any risk of the panel becoming entangled around the club shaft, primarily due to the support rod ensuring that the two coupling points and the chute rotate at the same rate around the club shaft.

EXAMPLE

Figure 1B:
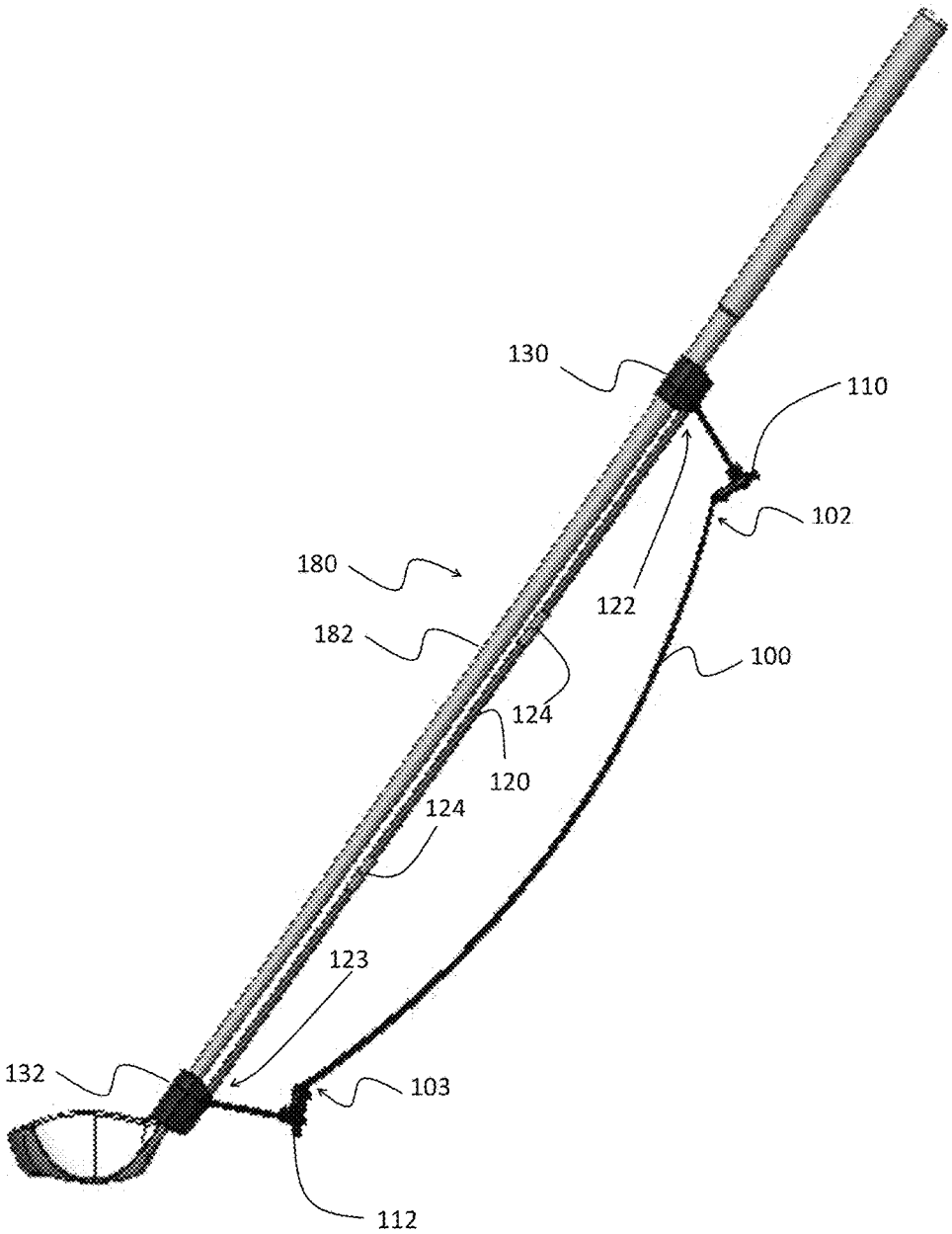
FIG. 1B is a side view of the golf training device of FIG. 1A.
Figure 1C:
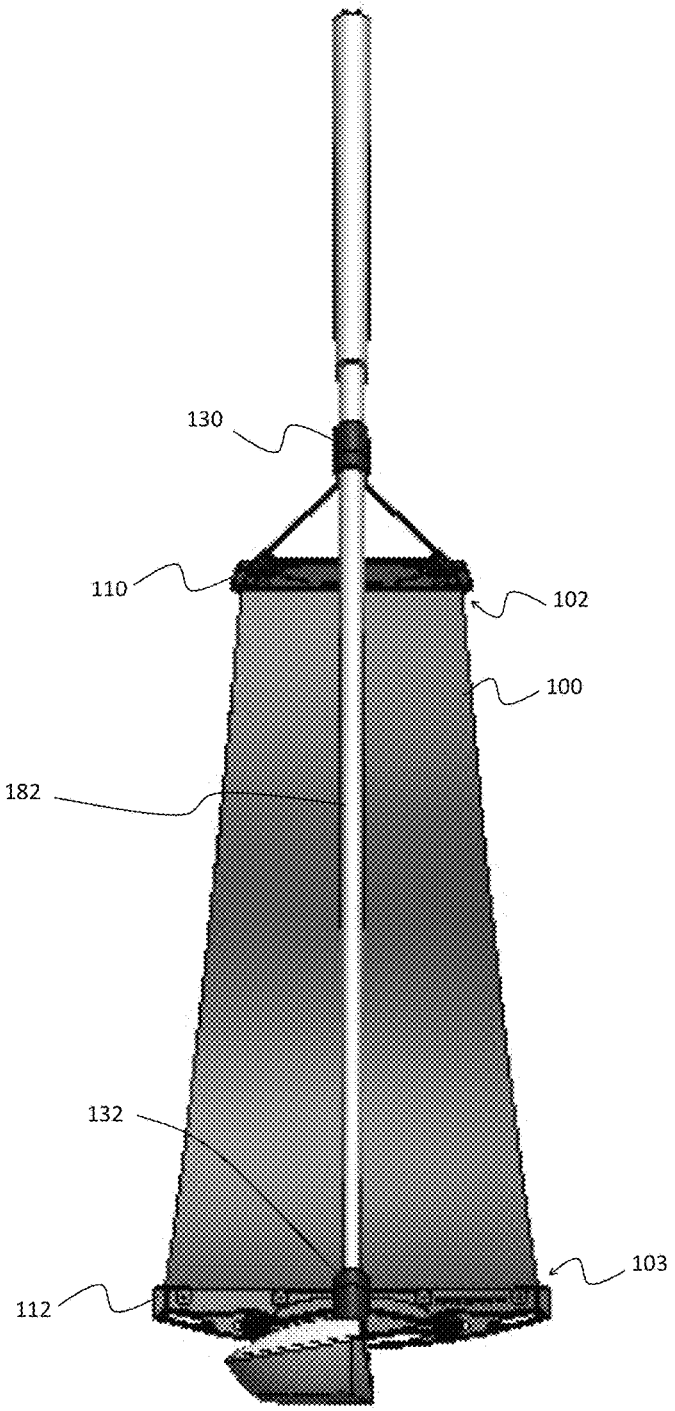
FIG. 1C is a front view of the golf training device of FIG. 1A.
Figure 1D:
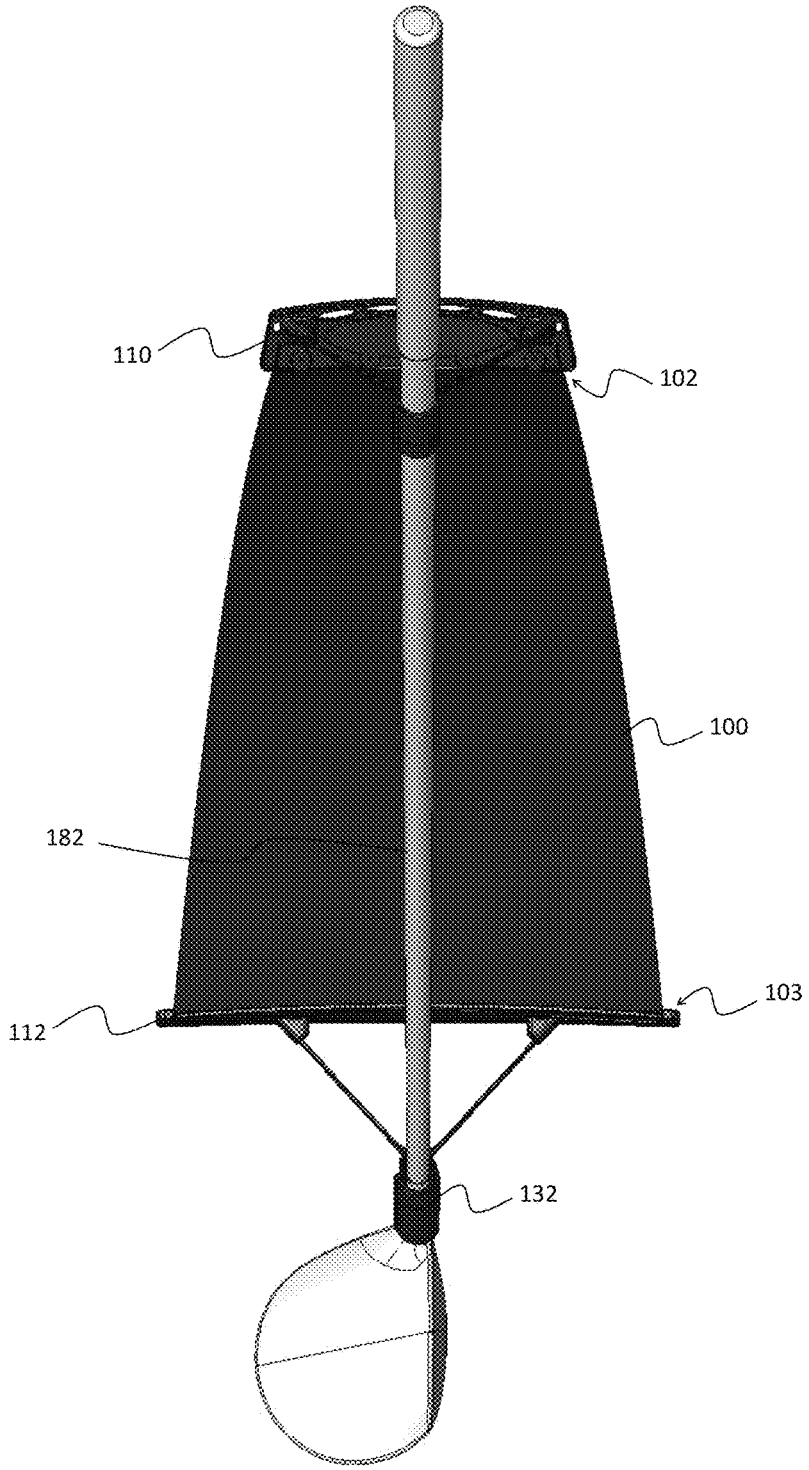
FIG. 1D is a front upper perspective view of the golf training device of FIG. 1C.
Figure 1E:
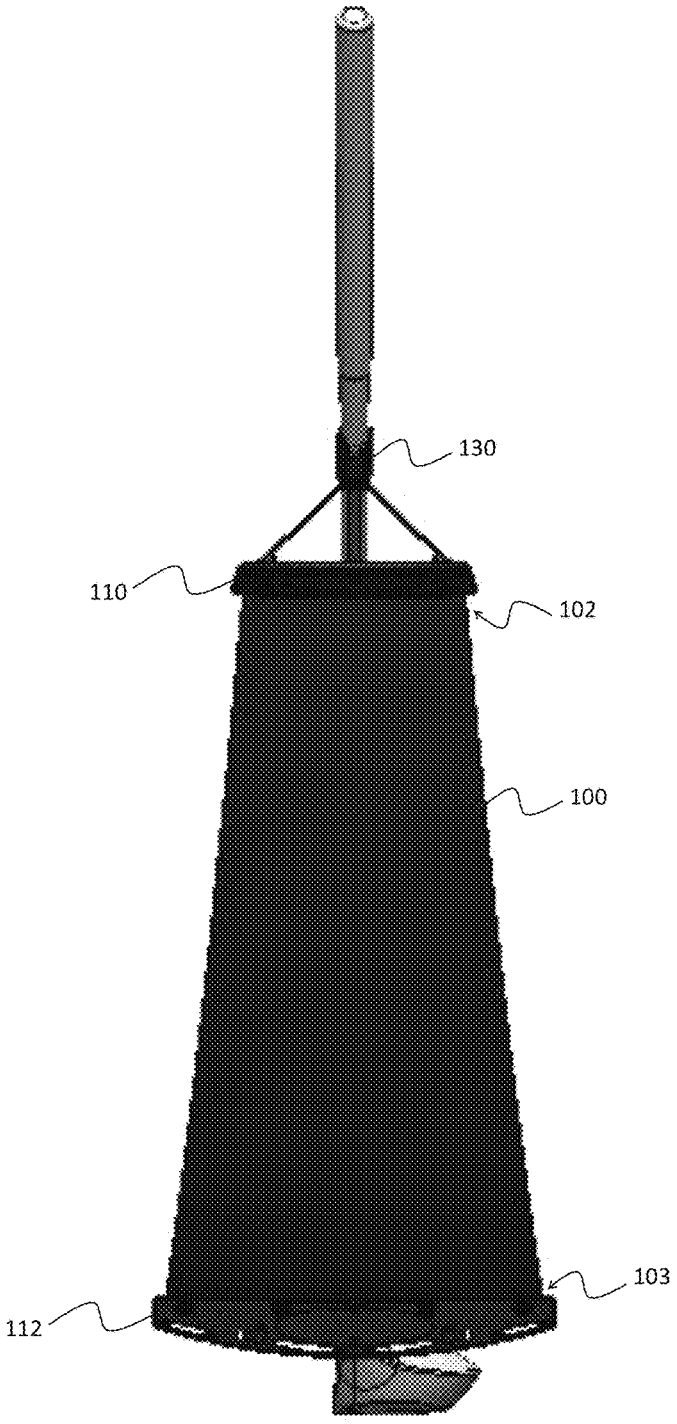
FIG. 1E is a rear view of the golf training device of FIG. 1A.
Figure 1F:
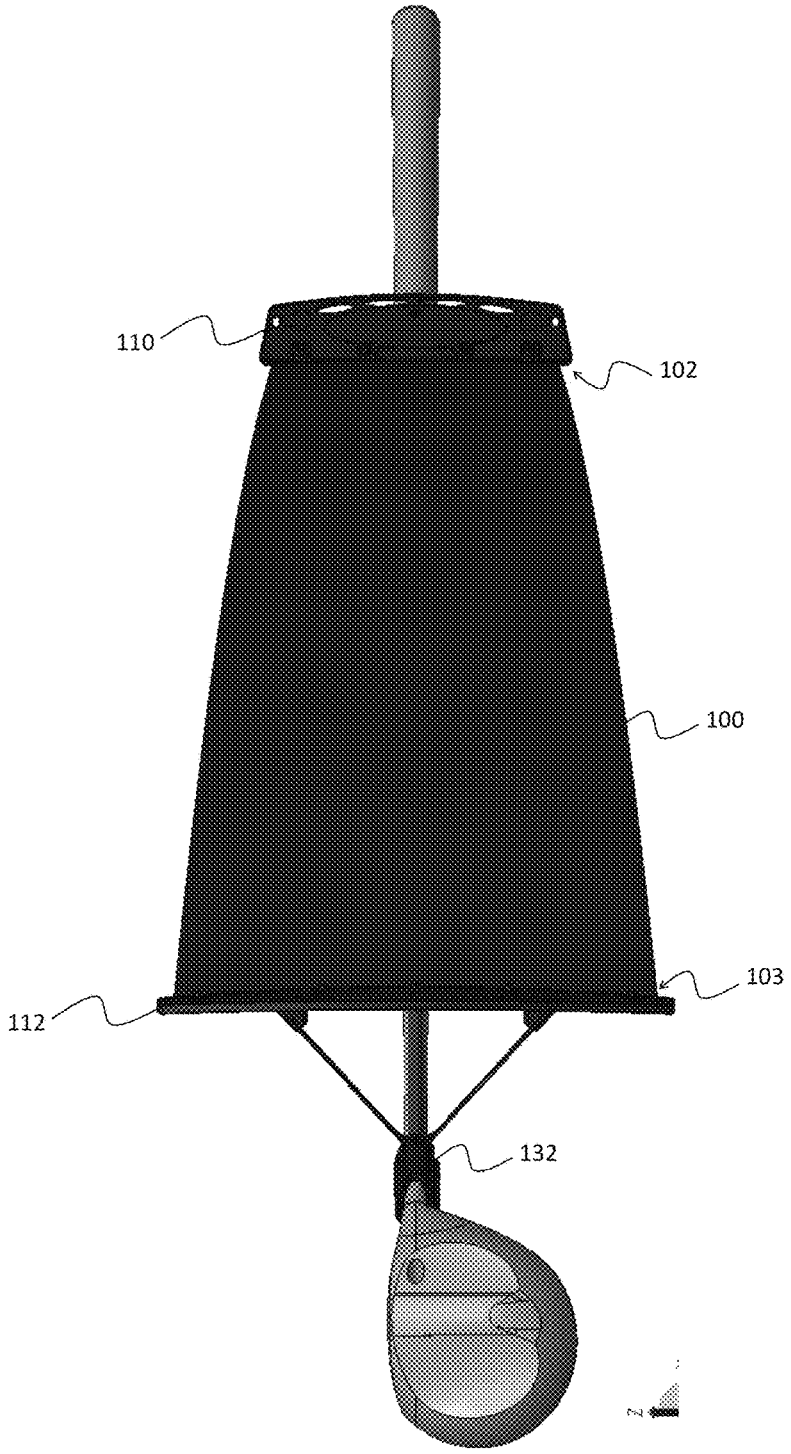
FIG. 1F is a rear lower perspective view of the golf training device of FIG. 1E.
Figure 2A:
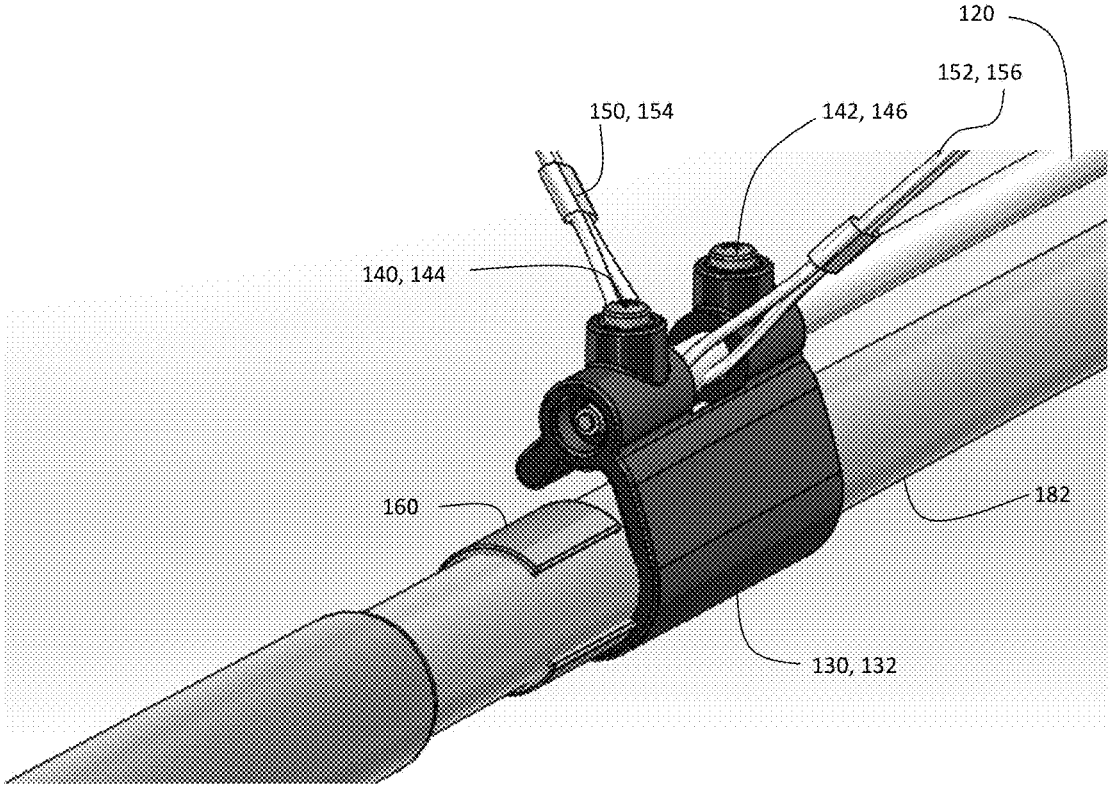
FIG. 2A is a close-up view of a connection point between a golf training device and a golf club, according to an embodiment of the current invention.
Figure 2B:
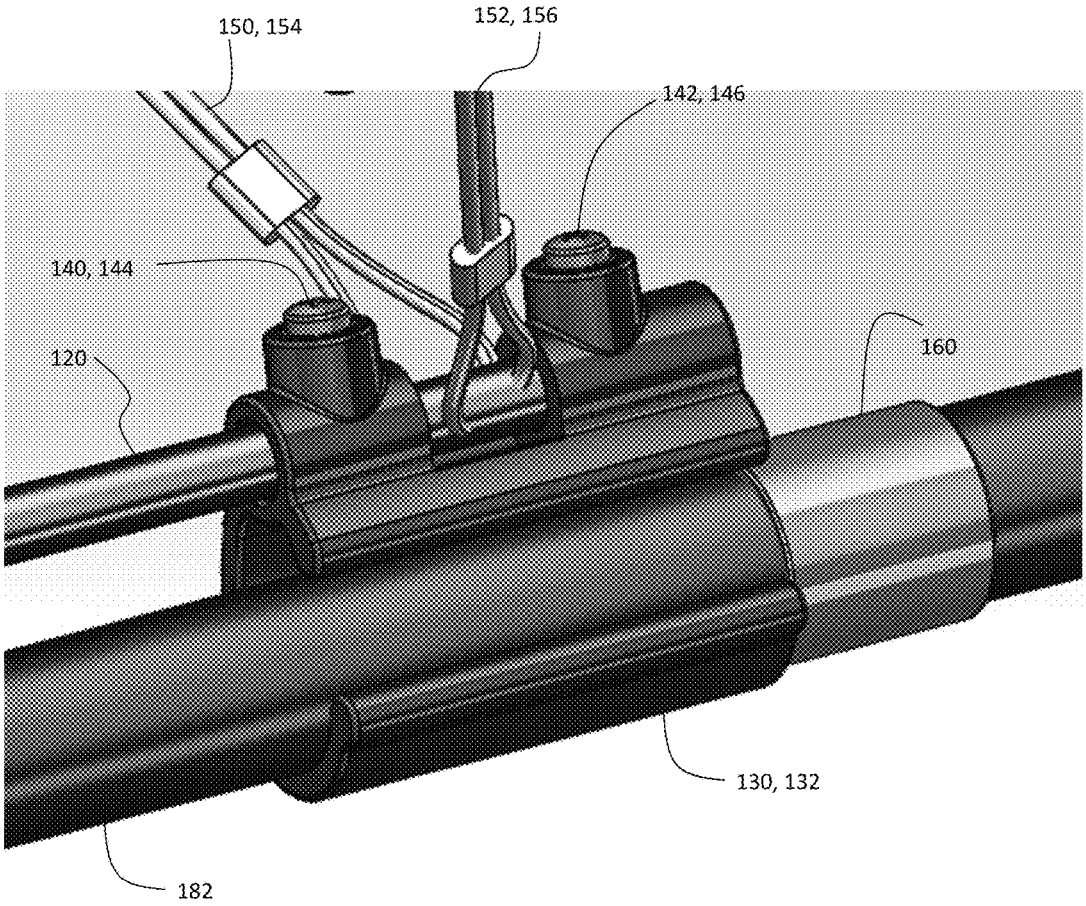
FIG. 2B is a further close-up view of the connection point of FIG. 2A.
Figure 2C:
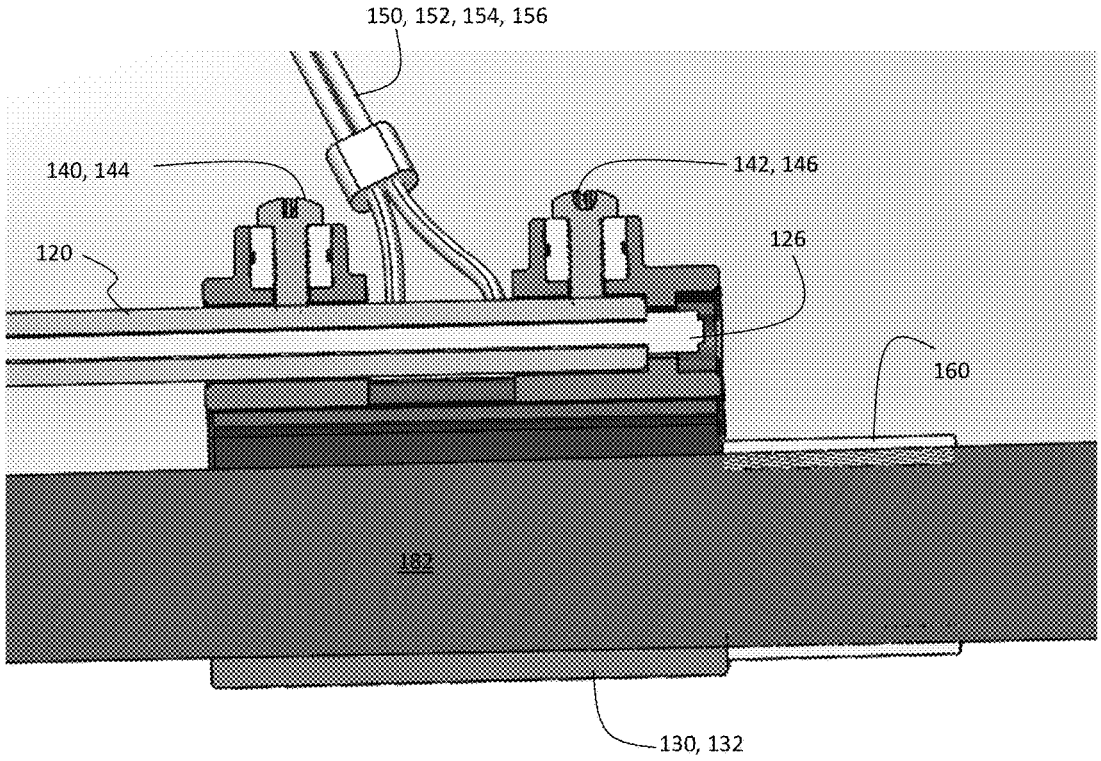
FIG. 2C is a cross-sectional view of the connection point of FIG. 2A.
Figure 3A:
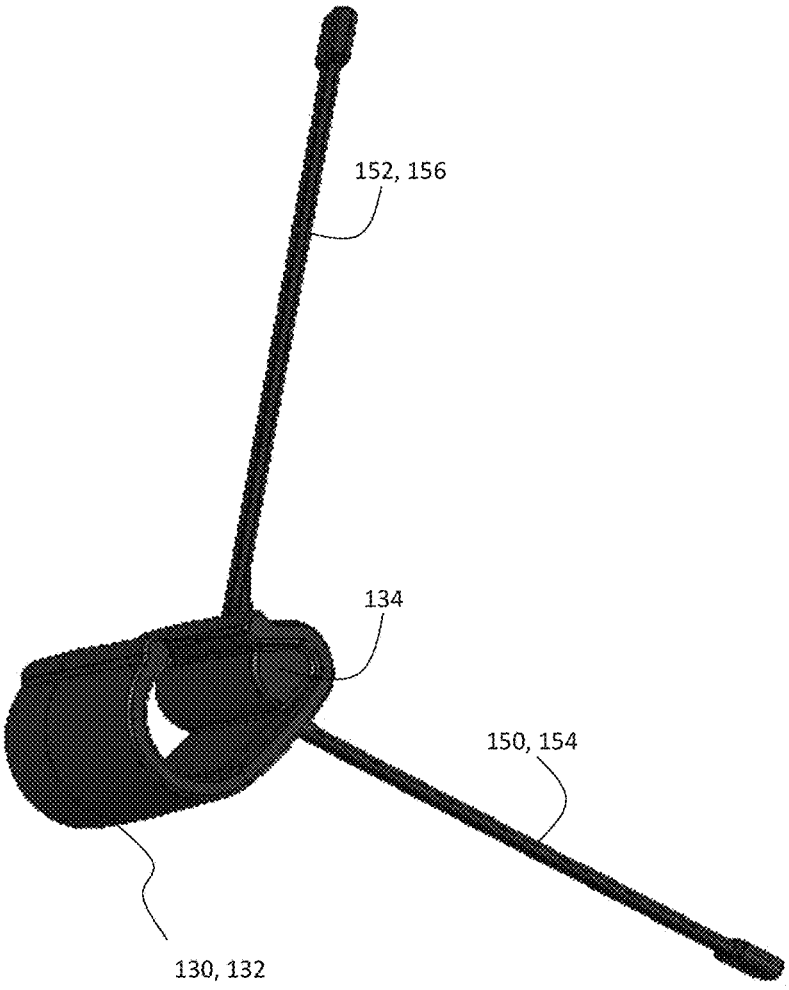
FIG. 3A is an isolated view of a coupling mechanism, according to an embodiment of the current invention.
Figure 3B:
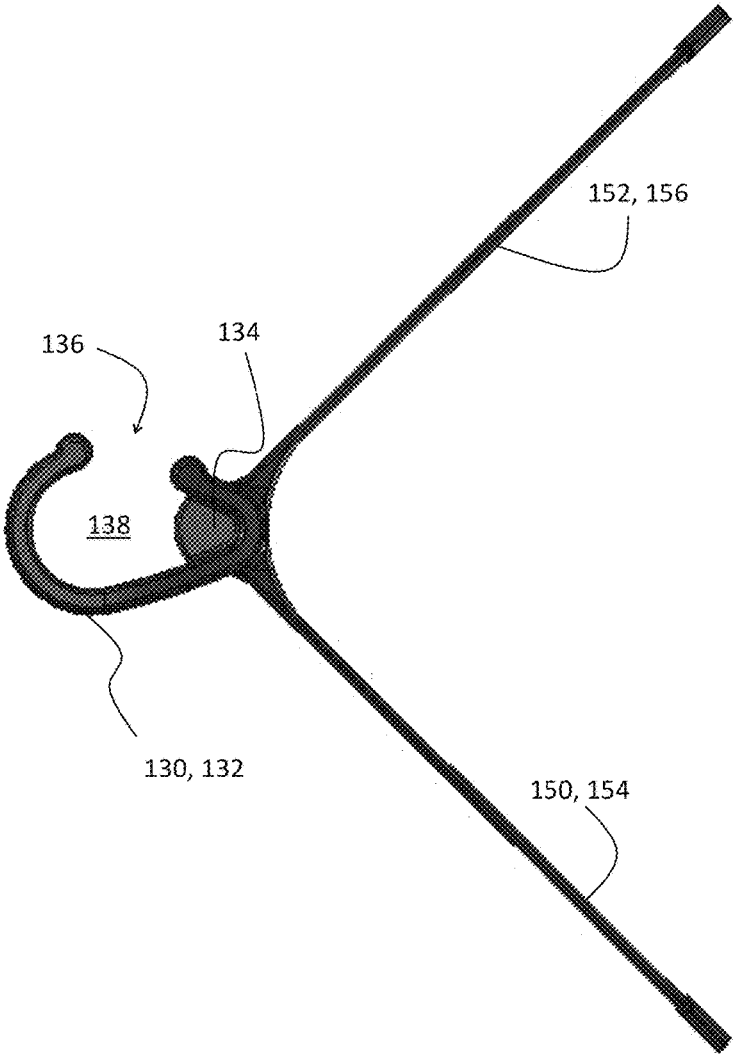
FIG. 3B is an end view of the coupling mechanism of FIG. 3A.
Figure 3C:
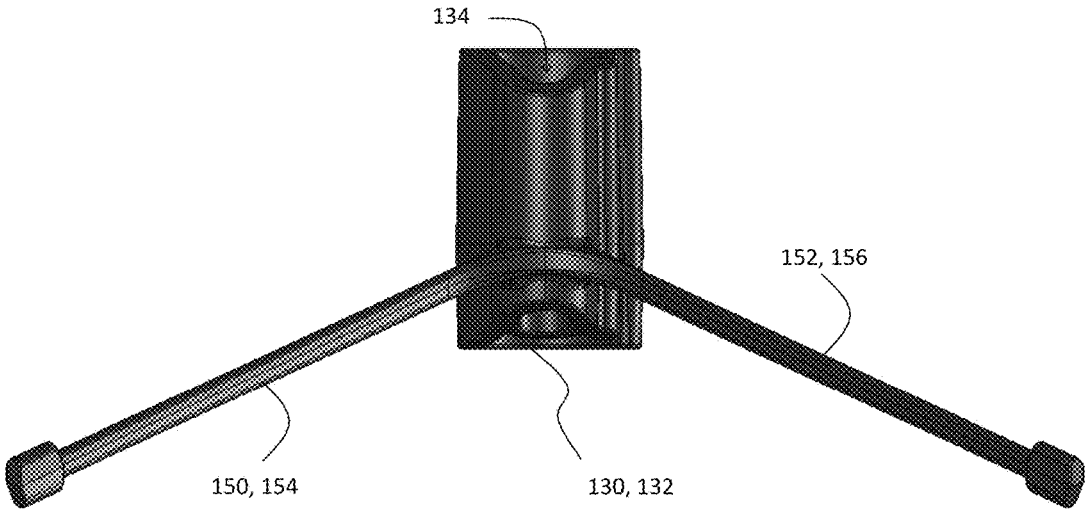
FIG. 3C is a rear view of the coupling mechanism of FIG. 3A.
Figure 4A:
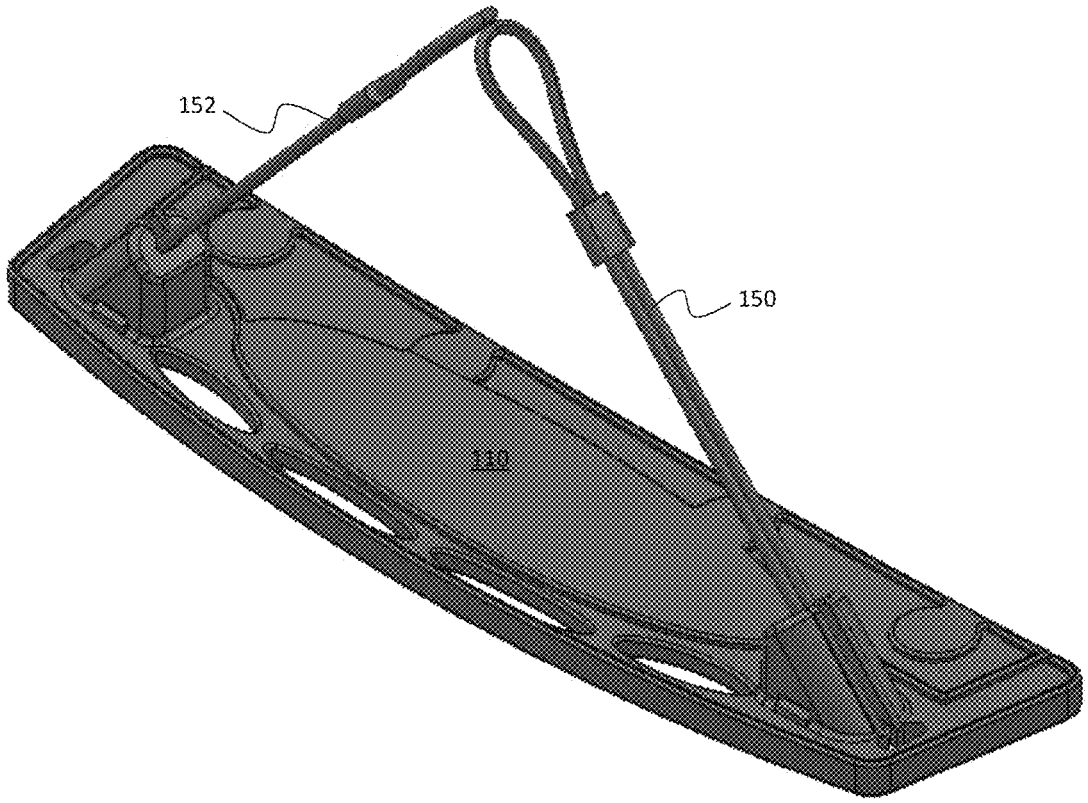
FIG. 4A is a perspective view of a proximal stiffener element with cable seals, according to an embodiment of the current invention.
Figure 4B:
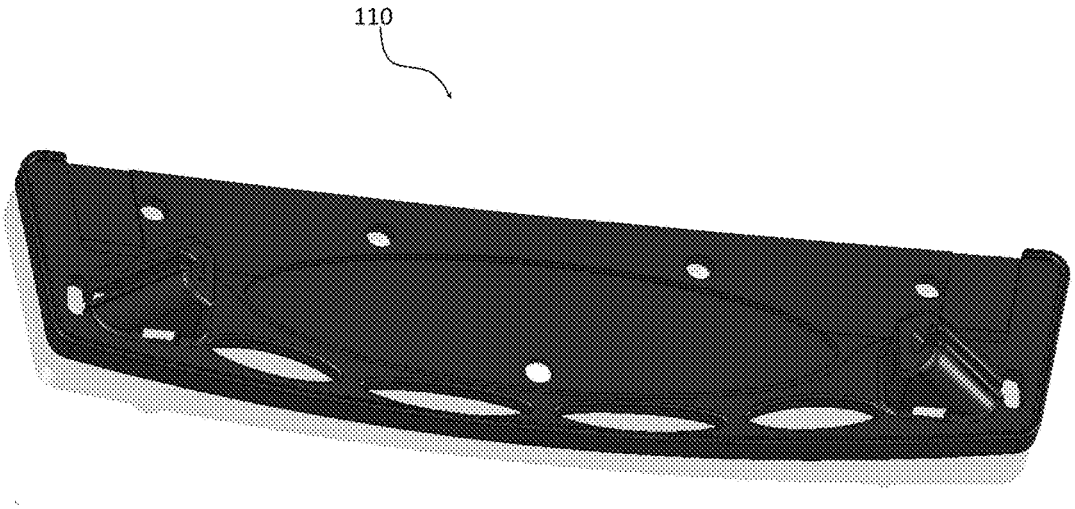
FIG. 4B is an isolated view of the proximal stiffener element of FIG. 4A.
Figure 5A:
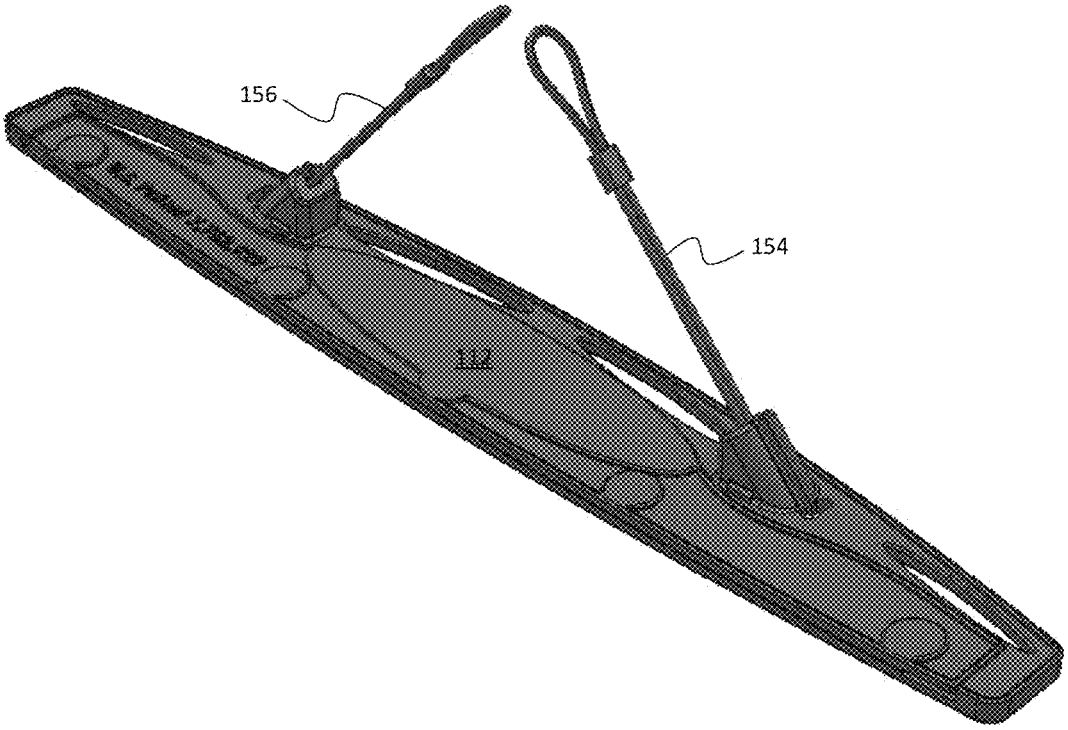
FIG. 5A is a perspective view of a distal stiffener element with cable seals, according to an embodiment of the current invention.
Figure 5B:
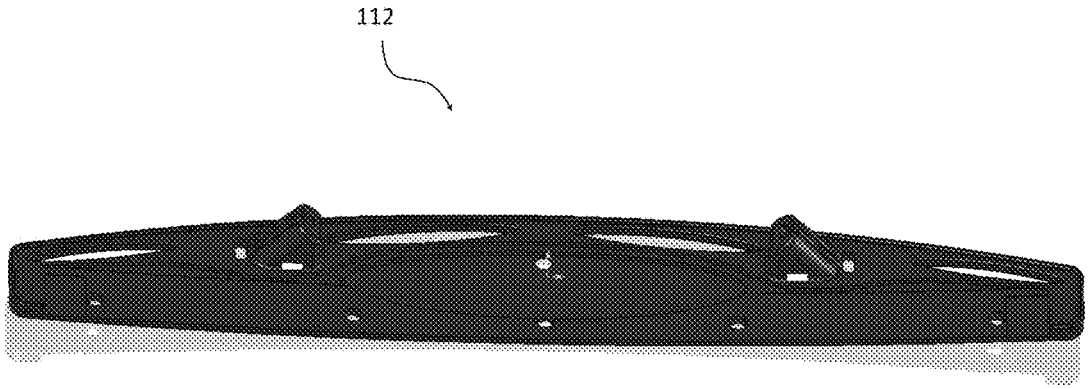
FIG. 5B is an isolated view of the distal stiffener element of FIG. 5A.

In certain embodiments, the current invention is a golf training device illustrated in FIGS. 1A-1F, 2A-2C, 3A-3C, 4A-4B, and 5A-5B, which show both the assembled training device and its components. The training device includes panel 100 with proximal edge 102 and distal edge 103. Proximal edge 102 of panel 100 is maintained taut/rigid along its length perpendicular to the length of swinging apparatus 180 by proximal stiffener element 110. Similarly, distal edge 103 of panel 100 is maintained taut/rigid along its length perpendicular to the length of swinging apparatus shaft 180 by distal stiffener element 112.

When the training device is in use (e.g., installed onto swinging apparatus 180), panel 100 can be substantially taut or can have slack, but its length is maintained substantially parallel to swinging apparatus shaft 182 via use of rigid support rod 120. This will become clearer as this specification continues. Support rod 120 is elongate and includes proximal end 122 and distal end 123. Support rod 120 also has one or more optional slip connectors 124 along its axis to facilitate breakdown and storage of the training device. If slip connectors 124 are present, elastic/bungee cord 126 may be positioned within support rod 120 along its length to maintain assembly of the segments of support rod among slip connectors 124. Support rod 120 is secured to coupling mechanisms 130, 132 via proximal end 122 of support rod 120 being inserted into slot 134 of proximal coupling mechanism 130 and distal end 123 of support rod 120 being inserted into slot 134 of distal coupling mechanism 132.

The friction between support rod 120 and coupling mechanisms 130, 132 within slot 134 may be sufficient to hold support rod in place. In certain embodiments, however, if further securement is needed, screws/bolts/studs 140, 142 can be used to tighten support rod 120 within proximal coupling mechanism 130, and screws/bolts/studs 144, 146 can be used to tighten support rod 120 within distal coupling mechanism 132.

As noted, proximal stiffener element 110 is disposed at proximal end 102 of panel 100, and distal stiffener element 112 is disposed at distal end 103 of panel 100. Panel 100 is coupled to support rod 120 via cable seals 150, 152 connecting proximal stiffener element 110 (to which panel 100 is secured) to proximal coupling mechanism 130 (to which support rod 120 is secured) and via cable seals 154, 156 connecting distal stiffener element 112 (to which panel 100 is secured) to distal coupling mechanism 132 (to which support rod 120 is secured). Cable seals 150, 152 may be coupled to proximal end 122 of support rod 120 between screws/bolts/studs 140, 142; and cable seals 154, 156 may be coupled to distal end 123 of support rod 120 between screws/bolts/studs 144, 146. It is contemplated herein that though cable seals 150, 152 have been specifically described herein, alternate mechanisms of coupling panel 100 and support rod 120 together directly or indirectly can be used, as long as they are coupled in a manner to allow them to rotate 360° in synchronization (i.e., at the same rate) about swinging apparatus shaft 182.

Each of coupling mechanisms 130, 132—through which swinging apparatus 180 is disposed—has an inner diameter/width that is larger than an outer diameter of swinging apparatus 180. In this way, with coupling mechanisms 130, 132 being the primary connection points between the training device and swinging apparatus 180, the training device can rotate 360° about shaft 182 of swinging apparatus 180 nearly frictionlessly. Coupling mechanisms 130, 132 may contact swinging apparatus shaft 182 during rotation thereabout, but this contact should not significantly alter or slow the rotation of coupling mechanisms 130, 132 about swinging apparatus shaft 182. Support rod 120 secured to coupling mechanisms 130, 132 (and also indirectly coupled to panel 100) permits the entire training device to rotate about swinging apparatus shaft 182 synchronistically, with no component of the training device remaining stationary on swinging apparatus 180 (i.e., all component described thus far rotate about swinging apparatus shaft 182).

Coupling mechanisms 130, 132 can take on any suitable shape or configuration, as long as each of their internal diameters are larger than an outer diameter of swinging apparatus shaft 182. Examples of such mechanisms include, but are not limited to, pipe clips, snap clamps, or even the specific structure illustrated in the figures. Specific to coupling mechanisms 130, 132 illustrated in the figures, entry/exit opening 136 is configured to receive swinging apparatus shaft 182 into and out of passageway 138. Opening 136 should have a length that is smaller than an outer diameter of swinging apparatus shaft 182, so that swinging apparatus shaft 182 cannot freely exit coupling mechanism 130, 132 (specifically passageway 136) when the training device is in use or otherwise implemented on swinging apparatus 180. Other embodiments of the current training device can use alternate structures for coupling mechanisms 130, 132 to attach the training device to swinging apparatus shaft 182 of swinging apparatus 180, where the substitute still permits 360° rotation around the center axis of shaft 180 and allows for movement proximally or distally along the length of shaft 182. This latter movement will now become clearer.

When the training device is applied to swinging apparatus 180 with coupling mechanisms 130, 132 disposed around swinging apparatus shaft 182, the training device would have the ability to shift vertically along the length of swinging apparatus shaft 182. Typically, this vertical translation would not hinder use of the training device or swinging apparatus 180 for the user during a swing of swinging apparatus 180, as the centripetal force experienced by the training device would shift the training device furthest distally. However, if it is desired that the training device not slide at all along the length of swinging sports apparatus 182, rubber clamp 160 can be disposed on swinging apparatus shaft 182 at a position proximal to proximal coupling mechanism 130, thus preventing the training device from sliding proximally. If swinging apparatus 180 is a golf club, the training device can be stopped from sliding distally by the club head. If swinging apparatus 180 is not a golf club or if the training device needs a supplemental component to stop itself from sliding distally, a rubber clamp can be disposed at a position distal to distal coupling mechanism 132.

GLOSSARY OF CLAIM TERMS

Clamp: This term is used herein to refer to any component that can be affixed to the shaft of the sports apparatus and thus prevent another component from sliding past it.

Coupling mechanism: This term is used herein to refer to a structural component that connects the support rod and panel of the current invention to the shaft of the sports apparatus, while also having the capability of rotating 360° about the center axis of the shaft. Examples include, but are not limited to, clasps, hasps, catches, hooks, buckles, clips, and any other suitable mechanism that can be used to accomplish the function and structural configuration described herein.

Distal: This term is used herein to refer to a position further from a user operating the underlying sports apparatus and training device.

Drag panel: This term is used herein to refer to a typically flexible chute or airfoil that provides air resistance when swinging it in a direction normal to its plane.

Proximal: This term is used herein to refer to a position closer to a user operating the underlying sports apparatus and training device.

Sports apparatus: This term is used herein to refer to equipment that is swung during operation thereof when playing a sport. Examples include, but are not limited to, golf clubs, baseball bats, tennis rackets, hockey sticks, and other equipment where it is beneficial to have increased air resistance during use thereof for the purpose of training and exercise.

Stiffener element: This term is used herein to refer to a structural component that provides a rigidity to an edge of the panel. This rigidity facilitates synchronized rotation of the training device about the shaft of the sports apparatus.

Substantially freely rotate: This term is used herein to refer to the ability of a structural component to turn or revolve around a shaft without obstruction or with minimal obstruction (i.e., nearly frictionless). The term "substantially" is used to indicate that the coupling mechanisms can rotate about the shaft of the sports apparatus but may have contact with the sports apparatus during rotation, thus causing minimal friction to be created between the coupling mechanisms and the sports apparatus. However, this contact should not substantially hinder rotation of the coupling mechanism.

Substantially parallel: This term is used herein to refer to the general disposition of two components having the similar overall direction along their lengths.

Substantially taut: This term is used herein to refer to a structural component being stretched, pulled tight, or otherwise lacking slack or having minimal slack.

Support rod: This term is used herein to refer to any shaft or bar having a predefined elongate shape. In certain embodiments, the rod can be secured on one end to the proximal coupling mechanism and secured on its opposite end to the distal coupling mechanism.

Synchronize: This term is used herein to refer to two events occurring at the same time and with the same speed.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A swinging sports training apparatus for attaching to a shaft of a sports apparatus, comprising:

a proximal coupling mechanism disposed around a proximal portion of the shaft of the sports apparatus and rotates 360° around the proximal portion of the shaft of the sports apparatus, the proximal coupling mechanism having an inner diameter that is larger than an outer diameter of the proximal portion of the shaft of the sports apparatus, such that the entirety of the proximal coupling mechanism substantially freely rotates about the sports apparatus;

a distal coupling mechanism disposed around a distal portion of the shaft of the sports apparatus and rotates 360° around the distal portion of the shaft of the sports apparatus, the distal coupling mechanism having an inner diameter that is larger than an outer diameter of the distal portion of the shaft of the sports apparatus, such that the entirety of the distal coupling mechanism substantially freely rotates about the sports apparatus;

a rigid support rod disposed in a substantially parallel relation to the shaft of the sports apparatus, the support rod having a proximal end secured to the proximal coupling mechanism and a distal end secured to the distal coupling mechanism, such that rotation of the proximal and distal coupling mechanisms about the shaft of the sports apparatus is synchronized with rotation of the support rod; and a drag panel having a proximal end and a distal end, the proximal end directly or indirectly coupled to the proximal coupling mechanism and the distal end directly or indirectly coupled to the distal coupling mechanism, wherein a length of the drag panel is substantially parallel to the support rod, wherein the proximal and distal coupling mechanisms rotate about the shaft of the sports apparatus, thus causing the panel to rotate about the shaft of the sports apparatus, wherein the drag panel rotates to trail the shaft of the sports apparatus during a swinging motion of the sports apparatus in order to provide resistance during the swinging motion, wherein the swinging sports training apparatus rotates around the shaft of the sports apparatus in a direction normal to a velocity vector of the swinging motion so that a user of the swinging apparatus experiences an increased resistance during the swinging motion due to the air resistance created by the panel, wherein none of the proximal coupling mechanism, the distal coupling mechanism, the support rod, and the panel are affixed to the shaft of the sports apparatus, due to all rotating in synchronization around the shaft of the sports apparatus.

2. A swinging sports training apparatus as in claim 1, wherein the panel is flexible but substantially taut during the swinging motion of the sports apparatus.

3. A swinging sports training apparatus as in claim 1, further comprising:

a proximal stiffener element coupled to the proximal end of the panel, so that a proximal edge of the panel remains perpendicular to the shaft of the sports apparatus; and a distal stiffener element coupled to the distal end of the panel, so that a distal edge of the panel remains perpendicular to the shaft of the sports apparatus.

4. A swinging sports training apparatus as in claim 3, further comprising a first cable seal that couples the proximal stiffener element to the proximal coupling mechanism, thus indirectly coupling the proximal end of the panel to the proximal coupling mechanism.

5. A swinging sports training apparatus as in claim 4, further comprising a second cable seal that couples the distal stiffener element to distal coupling mechanism, thus indirectly coupling the distal end of the panel to the distal coupling mechanism.

6. A swinging sports training apparatus as in claim 1, further comprising a clamp positioned on the shaft of the sports apparatus in a position proximal to the proximal coupling mechanism.

7. A swinging sports training apparatus as in claim 1, wherein the proximal coupling mechanism includes a proximal passageway through which the proximal portion of the shaft of the sports apparatus is disposed and a proximal entry/exit opening through which the proximal portion of the shaft of the sports apparatus can enter and exit the proximal passageway, wherein a length of the proximal opening is smaller than the outer diameter of the proximal portion of the shaft of the sports apparatus.

8. A swinging sports training apparatus as in claim 7, wherein the distal coupling mechanism also includes a distal passageway through which the distal portion of the shaft of the sports apparatus is disposed and a distal entry/exit opening through which the distal portion of the shaft of the sports apparatus can enter and exit the distal passageway, wherein a length of the distal opening is smaller than the outer diameter of the distal portion of the shaft of the sports apparatus.

9. A swinging sports training apparatus as in claim 1, wherein the proximal end of the support rod is secured to the proximal coupling mechanism by being disposed in a slot within the proximal coupling mechanism.

10. A swinging sports training apparatus as in claim 9, wherein the distal end of the support rod is secured to the distal coupling mechanism by being disposed in a slot within the distal coupling mechanism.

11. A swinging sports training apparatus as in claim 10, wherein a bolt, screw, or stud is used to tighten the proximal end of the support rod within the slot of the proximal coupling mechanism, and where an additional bolt, screw, or stud is used to tighten the distal end of the support rod within the slot of the distal coupling mechanism.

12. A swinging sports training apparatus as in claim 1, wherein the panel has a trapezoidal shape with a shorter side being a proximal edge of the panel and a longer side being a distal edge of the panel.

13. A swinging sports training apparatus as in claim 1, wherein the support rod includes slip connectors disposed therein for disassembling and folding the support rod.

14. A swinging sports training apparatus as in claim 13, further comprising an elastic cord disposed within an interior of the support rod along the length of the support rod.

15. The swinging sports training apparatus of claim 1, wherein the support rod has a Young's modulus of at least 10 GPa.

16. A golf training apparatus for attaching to a shaft of a golf club, comprising:

a proximal coupling mechanism disposed around a proximal portion of the shaft of the sports apparatus and rotates 360° around the proximal portion of the shaft of the sports apparatus, the proximal coupling mechanism having an inner diameter that is larger than an outer diameter of the proximal portion of the shaft of the sports apparatus, such that the entirety of the proximal coupling mechanism substantially freely rotates about the sports apparatus;

a distal coupling mechanism disposed around a distal portion of the shaft of the sports apparatus and rotates 360° around the distal portion of the shaft of the sports apparatus, the distal coupling mechanism having an inner diameter that is larger than an outer diameter of the distal portion of the shaft of the sports apparatus, such that the entirety of the distal coupling mechanism substantially freely rotates about the sports apparatus;

a rigid support rod disposed in a substantially parallel relation to the shaft of the sports apparatus, the support rod having a proximal end secured to the proximal coupling mechanism and a distal end secured to the distal coupling mechanism, such that rotation of the proximal and distal coupling mechanisms about the shaft of the sports apparatus is synchronized with rotation of the support rod, wherein the proximal coupling mechanism includes a proximal passageway through which the proximal portion of the shaft of the sports apparatus is disposed and a proximal entry/exit opening through which the proximal portion of the shaft of the sports apparatus can enter and exit the proximal passageway, wherein a length of the proximal opening is smaller than the outer diameter of the proximal portion of the shaft of the sports apparatus, wherein the distal coupling mechanism also includes a distal passageway through which the distal portion of the shaft of the sports apparatus is disposed and a distal entry/exit opening through which the distal portion of the shaft of the sports apparatus can enter and exit the distal passageway, wherein a length of the distal opening is smaller than the outer diameter of the distal portion of the shaft of the sports apparatus, wherein the proximal end of the support rod is secured to the proximal coupling mechanism by being disposed in a slot within the proximal coupling mechanism, wherein the distal end of the support rod is secured to the distal coupling mechanism by being disposed in a slot within the distal coupling mechanism, wherein a bolt, screw, or stud is used to tighten the proximal end of the support rod within the slot of the proximal coupling mechanism, and where an additional bolt, screw, or stud is used to tighten the distal end of the support rod within the slot of the distal coupling mechanism, wherein the support rod includes slip connectors disposed therein for disassembling and folding the support rod and an elastic cord disposed within an interior of the support rod along the length of the support rod, wherein the support rod has a Young's modulus of at least 10 GPa;

a drag panel having a proximal end and a distal end, the proximal end directly or indirectly coupled to the proximal coupling mechanism and the distal end directly or indirectly coupled to the distal coupling mechanism, wherein a length of the drag panel is substantially parallel to the support rod, wherein the proximal and distal coupling mechanisms rotate about the shaft of the sports apparatus, thus causing the panel to rotate about the shaft of the sports apparatus, wherein the panel is flexible but substantially taut during a swinging motion of the sports apparatus, wherein the panel has a trapezoidal shape with a shorter side being a proximal edge of the panel and a longer side being a distal edge of the panel;

a proximal stiffener element coupled to the proximal end of the panel, so that the proximal edge of the panel remains perpendicular to the shaft of the sports apparatus;

a distal stiffener element coupled to the distal end of the panel, so that the distal edge of the panel remains perpendicular to the shaft of the sports apparatus;

a first cable seal that couples the proximal stiffener element to the proximal coupling mechanism, thus indirectly coupling the proximal end of the panel to the proximal coupling mechanism;

a second cable seal that couples the distal stiffener element to distal coupling mechanism, thus indirectly coupling the distal end of the panel to the distal coupling mechanism;

a clamp positioned on the shaft of the sports apparatus in a position proximal to the proximal coupling mechanism, wherein the drag panel rotates to trail the shaft of the sports apparatus during the swinging motion of the sports apparatus such that the shaft of the sports apparatus is disposed along a middle portion of the drag panel during the swinging motion of the sports apparatus, wherein the swinging sports training apparatus rotates around the shaft of the sports apparatus in a direction normal to a velocity vector of the swinging motion so that a user of the swinging apparatus experiences an increased resistance during the swinging motion due to the air resistance created by the panel, wherein none of the proximal coupling mechanism, the distal coupling mechanism, the support rod, and the panel are affixed to the shaft of the sports apparatus, due to all rotating in synchronization around the shaft of the sports apparatus.

* * * * *